United States Patent [19]

Korsemann

[11] 4,171,583

[45] Oct. 23, 1979

[54] DISPLAY DEVICE

[76] Inventor: Jöergen K. Korsemann, 15 Classensgade, Copenhagen, Denmark, DK-2100

[21] Appl. No.: 761,378

[22] Filed: Jan. 21, 1977

[30] Foreign Application Priority Data

Jan. 23, 1976 [DK] Denmark ..... 262/76

[51] Int. Cl.[2] ..... G09F 1/12

[52] U.S. Cl. ..... 40/152; 40/10 D

[58] Field of Search ..... 40/152, 152.1, 156, 40/10 D

[56] References Cited

U.S. PATENT DOCUMENTS

| | | | |
|---|---|---|---|
| 100,962 | 3/1870 | Adams | 40/152 |
| 1,904,318 | 4/1933 | Lehere | 40/154 |
| 2,758,402 | 8/1956 | Fulmer | 40/152.1 |
| 3,820,262 | 6/1974 | Dewsnap | 40/10 D |
| 3,828,457 | 8/1974 | Willis | 40/152.1 |
| 3,914,888 | 10/1975 | Garrison | 40/152.1 |
| 3,974,343 | 8/1976 | Tolfsen | 40/152.1 |

*Primary Examiner*—Louis G. Mancene
*Assistant Examiner*—Wenceslao J. Contreras
*Attorney, Agent, or Firm*—George H. Gerstman

[57] ABSTRACT

A display device having a rear plate and a front plate that is at least partially transparent. A supporting rail underlies and is attached to the rear plate, with the supporting rail having a front edge that extends upwardly. The front edge is spaced from the rear plate the thickness of the front plate and is operable to allow the front plate to be pivoted to an open position, allowing an article such as a photograph to be inserted between the frcnt plate and the rear plate.

1 Claim, 4 Drawing Figures

DISPLAY DEVICE

Figure 3:
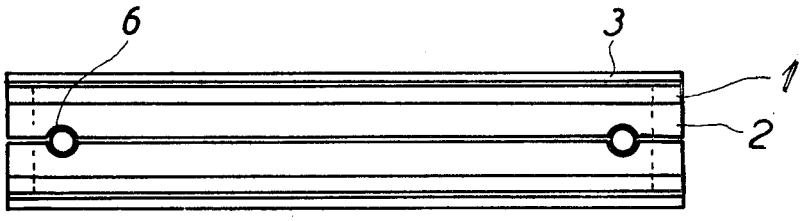

The invention relates to a board including a rear plate and a front plate, which are preferably entirely or partly transparent, said front plate being disconnectably attached to the rear plate.

Boards of this type can be used as picture frames in which the picture is inserted and retained between the rear plate and the transparent front plate. As the picture can be replaced by an other picture, such a frame is also called a replacement frame. Boards of this type can besides be used as so-called planning or notice boards, as a pre-printed sheet of paper can be inserted behind the front plate, after which various data can be drawn in or pasted on to the outside of the transparent front plate in a usually known manner. Finally such a board can be used in connection with display stands and the like, where required to be able to hand up and protect display posters, pictures and the like in a simple manner.

Hitherto known boards and arrangements for use as a board are all unnecessarily complicated and consequently expensive. As an example of such a construction can be mentioned the board frame which is known from DOS No. 2,246,393. From this is known a front plate which is suspended at its upper edge. This front plate being provided with a longitudinal bead, which engages a hollow rail releasably, which said rail can be attached to a rear plate or the like. This is an expensive construction, as it partly requires a special device at the front plate and partly has a rail of a complicated shape. From the specification of the U.S. Pat. No. 3.877 165 is furthermore known a picture frame, in which the two frame parts are hinged together at the lower edge by means of a special connecting piece. This frame which is mainly intended as a picture frame for reliefs, is expensive to make, as it is composed of specially made parts in all its details, and consequently is not fit for use, where the manufacture of frames of different dimensions is required.

The object of the invention is to remedy these drawbacks and to extend the field of application of such boards, and this is achieved according to the invention, when the front plate is coupled to the rear plate at its lower edge in a manner so as to be able to be swung out, said coupling being composed of a supporting rail which is attached to the rear plate, said supporting rail being provided with a front edge at distance from the front side of the rear plate corresponding to the thickness of the front plate, said front edge protruding from the rail.

By this construction a board is achieved by means of unusually simple means, which board works in a satisfactory manner and which in addition is inexpensive to manufacture. The board appears as an elegant and pure styled solution and it can be used as a picture frame, a planning board and a display board. When the front plate is loosened from its releasable attachment to the rear plate it can be effortlessly swung out about its lower edge at a suitable angle, in which it remains supported to the supporting rail, after which the insertion or removal of the material can easily be made. The weight of the front plate is thus absorbed by the rail and the front plate can be swung into its place and again be retained.

In using the rail and front edge, the operation of the board is further facilitated, as the front plate is now entirely or partly being kept in the swung out position as a facility for the user, and in using the front edge, the operation is likewise facilitated, as the front plate is kept in the yielding support. Finally it is appropriate to provide the rear plate with recesses, which make it possible, that the board can co-operate with a display stand and in addition that two boards can be assembled back to back and be kept to a stand.

Figure 1:
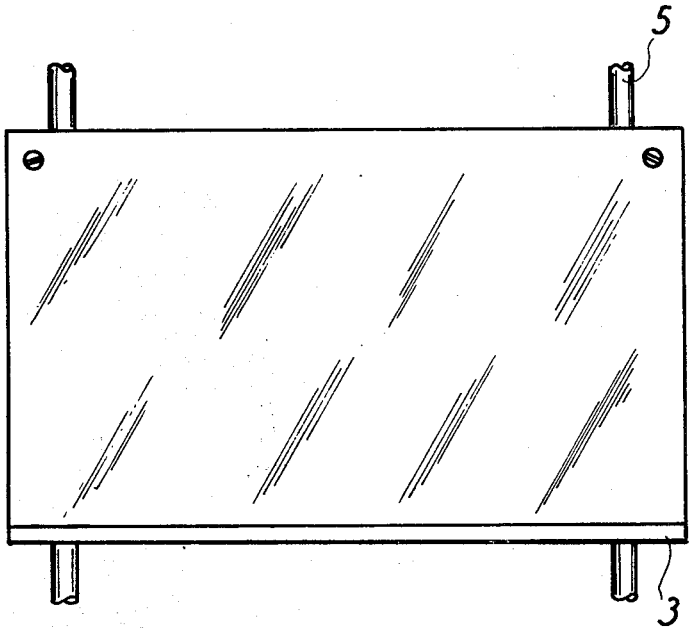
Figure 2:
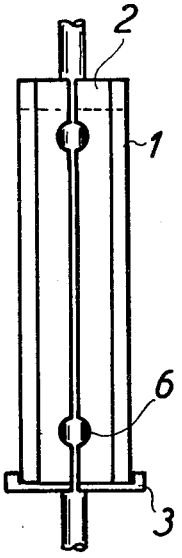
Figure 4:
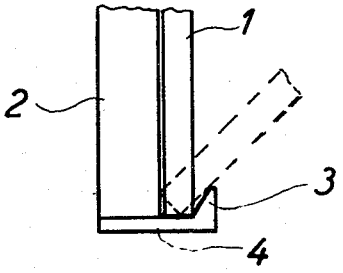

The invention will be described in details below with reference to the drawing in which FIG. 1 shows a board mounted on a stand as seen in front view, FIG. 2 shows the board in side elevation, FIG. 3 shows the board as seen in top view and FIG. 4 shows a detail of the supporting rail and front edge.

In FIGS. 1–3 is shown an embodiment of a board, in which two such boards are attached to a couple of vertical bars. As will be seen in FIGS. 2 and 3 the board is composed of a rectangular rear plate 2, which on its back is provided with recesses 6, the shape of which corresponds to half the cross section of the bars 5. These recesses may pass in any direction wanted e.g. as shown vertically and horizontally. As indicated by a dotted line there are furthermore means of screwing together, which make it possible to bolt two boards together to bars or the like, and which can in addition be used for attachment of a single rear plate to a wall for instance. At the lower end of the rear plate there is attached a supporting rail 4 as is more clearly shown in FIG. 4. This rail is at its front provided with an edge 3, protruding suitably and which also forms a track for a front plate 1 which can be placed in the track and supported by same. The edge 3 is seen in cross section and obliquely cut so that the track has at the rail a width equal to the thickness of the front plate and which is wider at the upper edge of the edge 3.

The front plate 1 is usually made of a transparent material and with outside dimensions as the rear plate. Furthermore the board is provided with means for keeping the front plate to the rear plate. These means can as required be screws as indicated in FIG. 1, or they may consist of clamps or like means which are releasable.

In FIG. 2 another embodiment of the supporting rail is shown. In this case the rail and the front edge are made of a yielding material and so dimensioned that the front plate is pressed against the rear plate both in the folded up position shown and in the swung out position not shown.

When starting the use of the board the first thing is to remove the above mentioned locking means keeping the front plate to the rear plate. Then the front plate can be swung out into a suitable angle in proportion to perpendicularity e.g. 45°. The front plate is kept in this position by means of the rail and the front edge as indicated by a dotted line in FIG. 4, while the insertion of a picture or the like is made. Then the front plate is again put into its place and locked to the rear plate by means of the above mentioned locking means.

Of course the board can be made to any imaginable dimension and adapted to special purposes all within the scope of the invention.

I claim:

1. A display device which comprises:

a rear plate for providing rear backing support for an article being displayed;

a front plate that is at least partially light-transmissive to permit the article being displayed to be viewed through the light-transmissive portion;

a supporting rail underlying said rear plate and said front plate and coupling said rear plate to said front plate;

the lower end of said rear plate being attached to said supporting rail whereby relative movement between said rear plate and said supporting rail is prevented; and said supporting rail having a main portion and a front edge portion, said main portion being dimensioned to underlie said rear plate and said front plate when the display device is in a closed position, said front edge portion extending upwardly from said main portion and being spaced from said rear plate the thickness of said front plate and operable to allow said front plate to be pivoted to an open position about said edge portion for insertion of the article to be displayed between said rear plate and said front plate, said front edge portion having a back side which faces a front side of said front plate, said back plate having a slope upwardly and outwardly from said supporting rail.

* * * * *